US005242077A

United States Patent [19]

Smith et al.

[11] Patent Number: 5,242,077

[45] Date of Patent: Sep. 7, 1993

[54] FRICTION FIT CONTAINER PARTITION

[75] Inventors: Ernest L. Smith, Kansas City; Kirk Klemme, Liberty, both of Mo.

[73] Assignee: Sealright Co., Inc., Overland Park, Kans.

[21] Appl. No.: 903,727

[22] Filed: Jun. 24, 1992

Related U.S. Application Data

[62] Division of Ser. No. 716,800, Jun. 18, 1991, Pat. No. 5,133,474.

[51] Int. Cl.[5] ..... B65D 25/08

[52] U.S. Cl. ..... 220/529; 220/554; 220/626; 220/352; 229/1.5 B

[58] Field of Search ..... 220/93, 554, 530, 529, 220/523, 626, 352, DIG. 21, 578; 215/364, 355; 229/1.5 B

[56] References Cited

U.S. PATENT DOCUMENTS

| | | | |
|---|---|---|---|
| 944,145 | 12/1909 | Nemsey . | |
| 1,135,713 | 4/1915 | Parker | 215/305 |
| 1,699,873 | 1/1929 | Brodsky . | |
| 1,744,973 | 1/1930 | Kuechenmeister . | |
| 1,754.524 | 4/1930 | Porter . | |
| 2,092,772 | 9/1937 | Nadelson . | |
| 2,110,616 | 3/1938 | Wilcox . | |
| 2,167,619 | 8/1939 | Bainton | 220/93 |
| 2,190,203 | 2/1940 | Barnard | 220/93 |
| 2,287,610 | 6/1942 | Guidry . | |
| 2,324,670 | 7/1943 | Bergen . | |
| 2,616,590 | 11/1952 | Opdyke | 220/93 |
| 2,761,423 | 9/1956 | Heidler | 220/554 |
| 2,820,580 | 1/1958 | Figge . | |
| 3,015,429 | 1/1962 | Morici . | |
| 3,164,289 | 1/1965 | Cocchiarella . | |
| 3,182,890 | 5/1965 | Elam . | |
| 3,288,344 | 11/1966 | Woollen et al. . | |
| 3,323,706 | 6/1967 | Gereke | 229/1.5 |
| 3,349,941 | 10/1967 | Wanderer . | |
| 3,385,503 | 5/1968 | Stump . | |
| 3,781,942 | 1/1974 | Coleman . | |
| 3,924,774 | 12/1975 | Donnelly | 220/93 |
| 4,061,782 | 12/1977 | Baxter | 229/1.5 B |
| 4,096,947 | 6/1978 | Morse | 229/1.5 B |
| 4,682,705 | 7/1987 | Hurwitz . | |
| 4,723,674 | 2/1988 | Nunes . | |
| 4,773,556 | 9/1988 | Smith . | |
| 5,117,998 | 6/1992 | Handzel | 220/93 |

FOREIGN PATENT DOCUMENTS

| | | | |
|---|---|---|---|
| 300809 | 1/1989 | European Pat. Off. | 220/529 |
| 15578 | 1/1908 | United Kingdom | 200/93 |

*Primary Examiner*—Allan N. Shoap
*Assistant Examiner*—S. Castellano

[57] ABSTRACT

A removable partition for dividing a container into compartments. In a first embodiment the partition takes the form of an upper paper disk and a lower foam disk. The edges of the partition are bent upwardly such that the edge portion of the foam will contact the interior of the container, providing a much better hold than just paper. In a second embodiment, the partition is formed of upper and lower paper disks. The disks are secured together in an area spaced inwardly from the edges, such that the edges of the disks are not connected. The edges may thus be slightly spaced and provide a wider area of engagement with the inner walls of the container, providing a better hold than a single paper disk.

6 Claims, 2 Drawing Sheets

FRICTION FIT CONTAINER PARTITION

This is a division of application Ser. No. 07/716,800, filed Jun. 18, 1991, now U.S. Pat. No. 5,133,474.

BACKGROUND OF THE INVENTION

1. Field of the Invention

This invention relates in general to the packaging of foods and more particularly to a closure for a food container for partitioning the container. This invention also relates to a method of forming a friction fit between a paper disk closure and the inside of a container to define compartments within the container.

2. Description of the Prior Art

Annular channels or grooves are often integrated into food containers so that a disk or partition may be situated within the channel to define a compartment or to divide the container into two or more compartments. Also, these channels or grooves can be positioned at any desired level between the top and bottom of the container.

Because the disks are often snap-fitted into place in the annular grooves, these containers are susceptible to sift leakage between compartments when used to contain powdered products. Additionally, the annular grooves are a permanent feature of the container. If a change in compartment size is desired, a new container with the proper groove location must be made.

U.S. Pat. No. 1,744,973 (Kuechenmeister) describes a paper tube or container in which several circular metallic disks are secured to define compartments. The disks are provided with a series of spaced concentric annular corrugations. In use, the disks are positioned at the desired level within the container body, and the corrugations are flattened to radially expand the disk, causing the edges of the disk to embed in the container. This is similar to the annular grooves above, except that the disk forms its own groove.

U.S. Pat. No. 2,324,670 (Bergen) disclose within a container which does not employ a groove. Flaps are formed at the edges of the partition, and these flaps are fixed permanently to the inner sides of the container to position the partition.

SUMMARY OF THE INVENTION

It is an object of the present invention to provide a container partition having a secure seal with the container so that the partition is sift resistant for powdered products and is not easily dislodged.

It is also an object of the present invention to provide a partition which, depending on the size thereof, can be positioned at any level within the container, making the compartment size adjustable by replacement of only the partition.

It is a further object of this invention to provide a partition which can be situated at any level within a container without the need for an annular groove or partition seat.

It is a yet another object of this invention to provide a partition which allows a plurality of partitioned containers to be nested.

To accomplish these and other objects of the invention, a friction fit partition for a container is provided. In one embodiment, the partition comprises a circular paper disk. A pull tab is die cut into the paper disk, and a think foam disk is laminated to the bottom of the paper disk. Edges of the partition are bent upwardly such that the foam faces outwardly to engage the inner walls of the container. The foam provides higher friction to fix the partition in place. The foam disk also seeks to expand and thus acts like a gasket, while the paper provides stiffness.

In a second embodiment, two paper disks are laminated together, one of which has the pull tab, and the edges of the disks are "fluffed" to provide a sealing surface between the disks and the inner walls of the container. The friction fit disk closure does not require an annular groove or disk seat in either embodiment, but such a groove or set may be incorporated.

BRIEF DESCRIPTION OF THE DRAWINGS

The present invention is described in greater detail with reference to the accompanying drawings in which like reference numerals are used to indicate like parts, and in which.

DETAILED DESCRIPTION OF THE INVENTION

Figure 1:
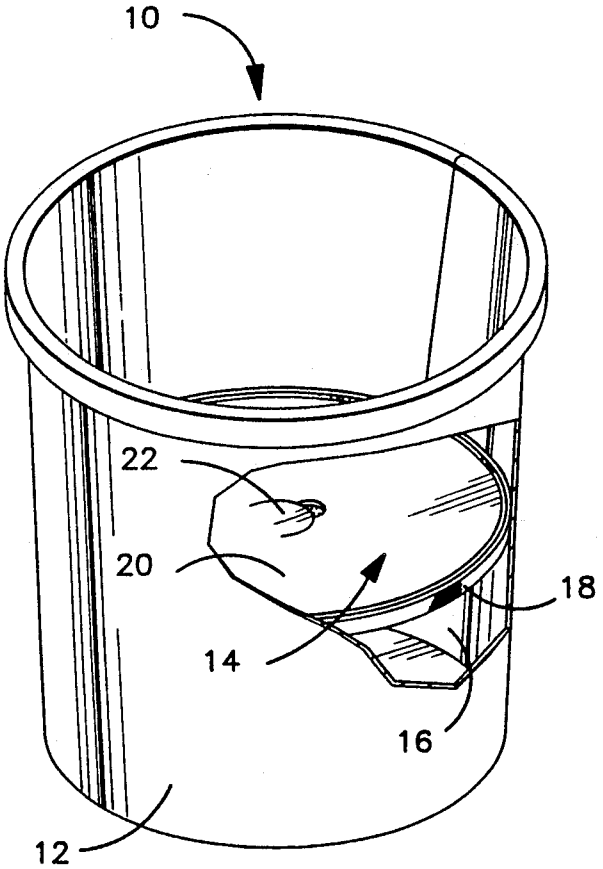
FIG. 1 is a perspective view in partial cutaway of a container with a partition according to a first embodiment of the invention.

Referring now to the drawings in greater detail, in FIG. 1 reference numeral 10 broadly designates a container assembly according to the present invention. Container assembly 10 comprises a container 12, formed of paperboard or plastic, and a friction fit partition 14. When the partition 14 is positioned in the container 12, it defines a lower compartment 16 within the container.

Figure 2:
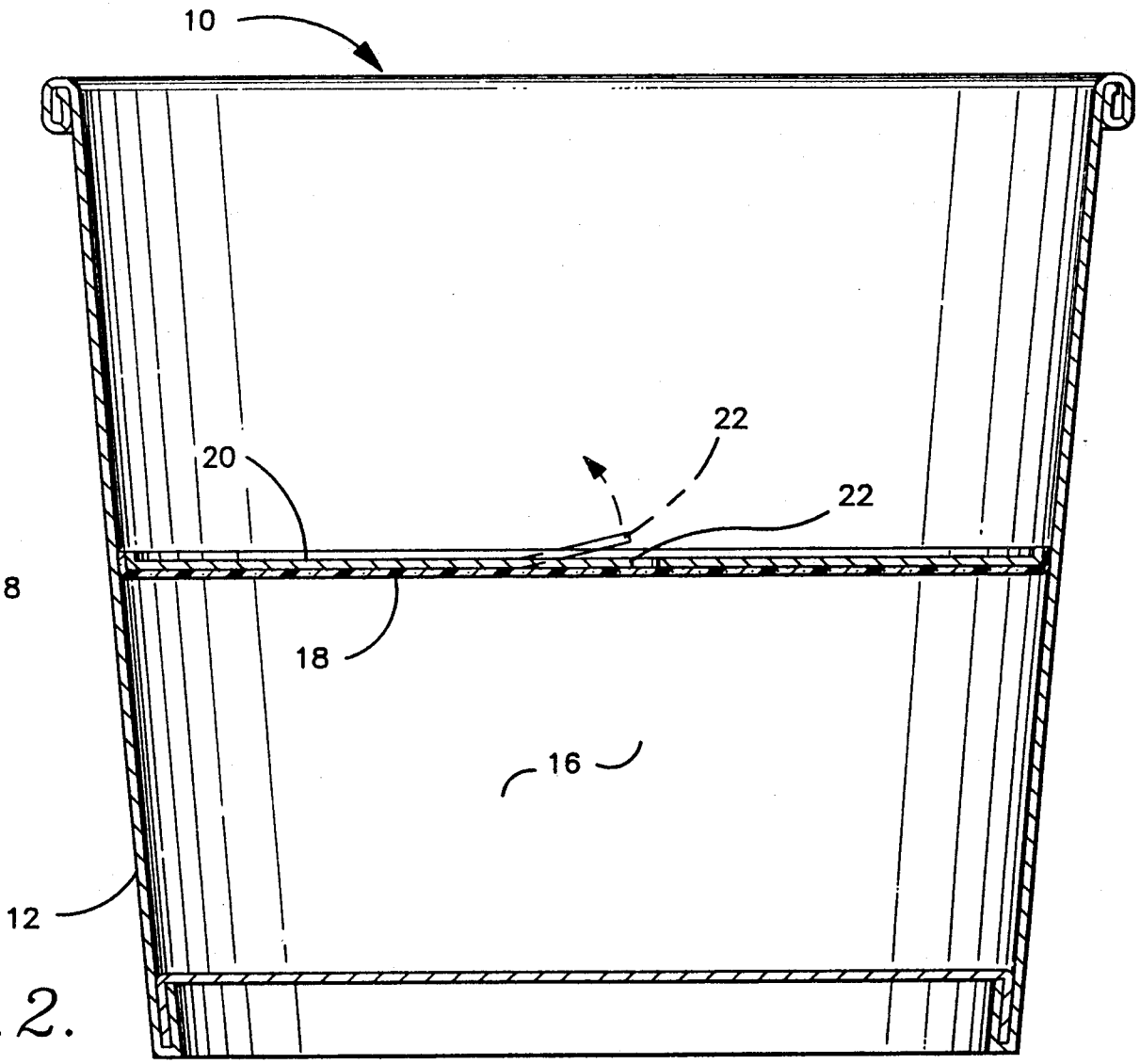
FIG. 2 is a cross sectional view of the container and partition of FIG. 1.

In the embodiment shown in FIGS. 1 and 2, the partition 14 comprises a thin foam disk 18 and a circular paper disk 20. The paper disk 20 may be formed of light to medium card stock, and may include a protective wax or plastic coating on its exposed face to retard moisture migration. The foam disk 18 may be a thin layer (approximately 0.75 mm) of polyethylene foam.

The disks 18 and 20 may be laminated together, or may be connected by an appropriate adhesive. Prior to or after lamination, a pull tab 22 is formed in the paper disk 20 as by die cutting. If the particular products held in the compartments of the container should be kept totally separate, it may be preferred to die cut tab 22 prior to lamination to avoid any possibility of forming a cut through foam disk 18. The pull tab 22 allows easy removal of partition 14 from its position within the container 12, as will be described below.

As shown in FIG. 2, the edges of the partition 14 are folded upwardly such that the peripheral edge of the foam disk 18 contacts the sloped inner wall of the container 12 at the point at which the diameter of partition 14 corresponds to the diameter of container 12. The partition 14 is thus wedged within the container 12 by an interference fit.

The foam may have a coefficient of friction slightly higher than the particular paper used for paper disk 20, especially if the paper has been coated. This improves the wedging of the partition, and helps to prevent the partition from moving upwardly out of the interference fit. Additionally, while the paper disk 20 is essentially rigid and provides support, the foam will be at least partially collapsed upon insertion of the partition into the interference fit. The elastic foam will, however, attempt to expand from this collapsed position. This attempted expansion will cause outwardly directed forces to act against the container 12 along the entire periphery of the partition, further holding the partition in place.

Finally, the upwardly bent periphery of the partition will attempt, to some extent, to return to the unbent position due to the restitution properties of the paper and/or foam. This will cause a small outwardly directed force similar to that noted above. This will also result in the outer periphery of the partition expanding slightly if the partition is moved upwardly out of the fully wedged position. Thus, small movements of the partition will be compensated for and will not result in the partition being fully removed from the interference fit. If the coefficient of friction of the foam is sufficiently high, the partition will attempt to fully unbend if an upward force is applied to the pull tab 22, making accidental removal unlikely.

The upwardly bent periphery of the partition 14 may be formed by supporting the upper, or paper, side of the partition in those portions not to be bent, and then forcing the partition into an appropriately shaped die. In a preferred alternative embodiment (shown in FIG. 6), the paper disk may be formed slightly smaller than the desired outer diameter of the partition. The foam disk is formed with a diameter larger than that of the paper disk, such that the foam extends beyond the periphery of the paper disk. Since the foam is much more pliable than the paper, no pre-bending is necessary. Simply inserting such a partition into the container will cause the foam to bend upwardly over the edge of the paper disk.

It should be noted that the above-described partition does not require a container having a peripheral groove acting as a seat for the partition. The wedging action previously described is sufficient to maintain the partition in place. From this it should be clear that the placement of the partition in the container is a function only of the size or diameter of the partition. Any given size of partition will simply wedge within the container at the point at which the partition size equals the inner peripheral size of the container. Thus, the size of compartment 16 is not fixed by a peripheral groove in the container, but is simply dependent upon the size of partition employed. The size of compartment 16 may be changed merely by using a disk of different size, and does not require a different container with a peripheral groove at a different level, with a different partition to fit this new peripheral groove.

Figure 3:
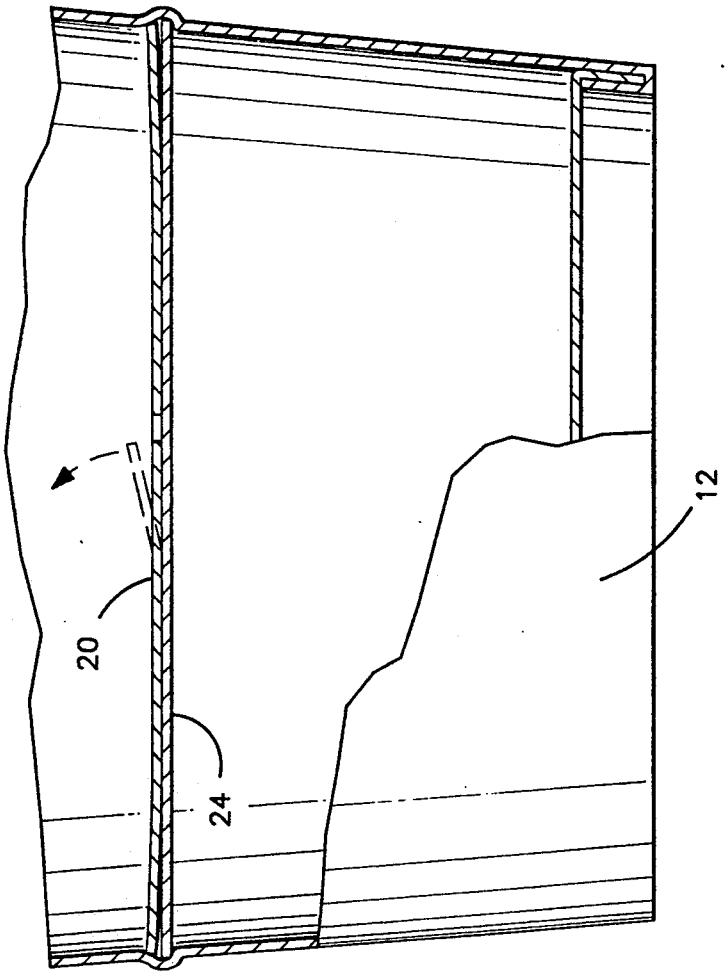
FIG. 3 is a partial cross sectional view of a container with a partition according to a second embodiment of the invention.

A second embodiment of the present invention is shown in FIG. 3. In this embodiment the paper disk 20 is formed as before. However, instead of a foam disk, a second paper disk 24 is fixed to the lower face of paper disk 20. This is preferably accomplished by placing two webs of paper on top of each other and punching out both disks at once. Prior to the punching, the two paper disks are fixed together by adhesive. The adhesive is applied near the center of the disks (more particularly, near where the center of the disks will be after punching). In other words, the periphery of the disks are not adhesively joined.

The lack of a bond at the periphery of the partition results in the edges of the two disks being spaced from each other vertically as shown in FIG. 3. The punching step may exaggerate this distance.

The fact that the edges of the disks are not contiguous results in the periphery of the partition being "fluffed" up compared to a single paper disk. This results in a greater surface are at the edge of the partition to contact the inner wall of the container 12. Since two disk edges must be dislodged to allow movement of the partition, the partition is less likely to be displaced than a single paper disk. As with the first embodiment, the size of the lower compartment defined is dependent upon the size of the partition.

Although this second embodiment is more reliable than a single paper disk, it may not be sufficiently held against displacement for some applications. In those instances, the partition may be used in conjunction with a known peripheral groove in the wall of the container, as is shown in FIG. 3. The edges of the partition will fit within the groove, with the partition preferably being slightly larger than the size of the container just above the groove. Of course, the first embodiment of the partition shown in FIGS. 1 and 2 may also be used with a peripheral groove in the container for even more security against displacement of the partition.

Figure 4:
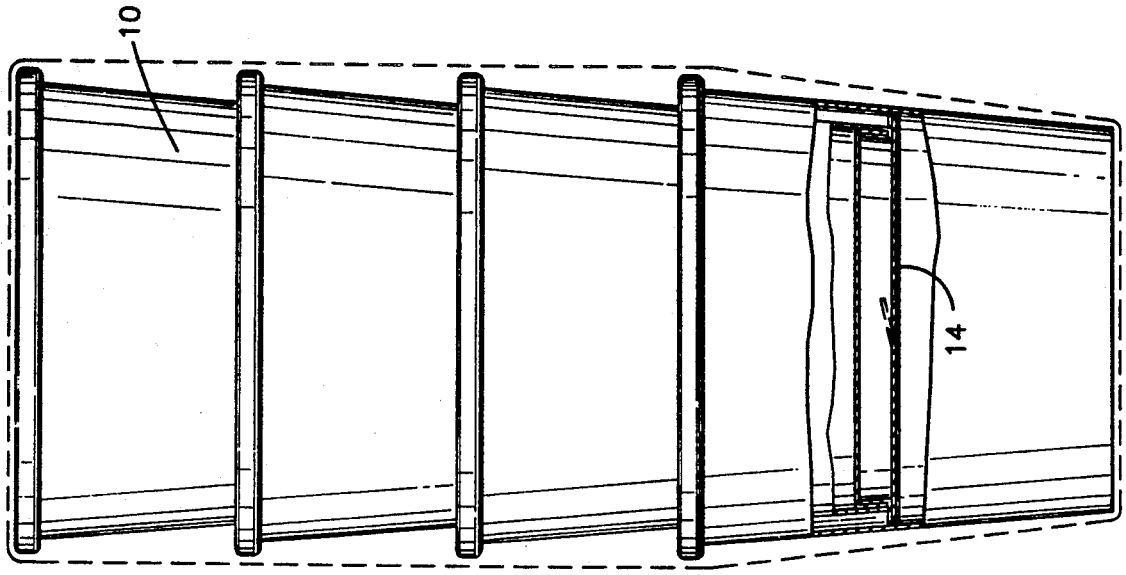
FIG. 4 is a plan view in partial cross section of a plurality of nested containers partitioned according to the present invention.

The secure nature of the present partitions allows containers employing these partitions to be stacked in a nesting relationship as shown in FIG. 4. The bottoms of the upper containers rest upon the partitions of the containers below, and this weight further serves to maintain the partitions in place. The nested containers may be surrounded by a common wrapper of cellophane or known plastics. In this manner, a plurality of containers may be shipped or sold as a common unit with the nesting arrangement providing a considerable space savings.

In use, a food product such as powdered soup is placed in container 12. A partition 14 of either embodiment is inserted to a position above the level of the food product (the correct size of partition to achieve this position having been previously determined). The container may then receive an individual wrapping for sale, or may be stacked and wrapped for sale as shown in FIG. 4.

When the consumer desires to eat the soup, the wrapping, if any, is first removed. The pull tab 22 is bent slightly upwards to allow easier grasping of the pull tab. The closure 14 is then manually removed by pulling upwardly on the pull tab 22. Next, a predetermined amount of water is added to the container 12. The water may be preheated, or the entire container may be placed in a microwave oven for heating. Finally, the container 12 holds the soup while it is being consumed.

It will be apparent to one of ordinary skill in the art from the foregoing description that many modifications may be made without departing from the spirit of the invention. In this regard it is particularly noted that the container need not be frusto-conical, but may have other downwardly tapered configurations. Therefore, the scope of the present invention is not to be limited to the particular details illustrated herein, but shall be defined by the claims appended hereto.

What is claimed is:

1. A friction fit partition adapted to be seated against at least one interior wall of a downwardly tapered container, comprising;

a support member having top and bottom faces and a peripheral edge, said peripheral edge having a configuration substantially corresponding to the interior peripheral configuration of the container, and said support member having an area less than the largest interior cross sectional area of the container; and a bottom member having a peripheral edge substantially identical to, and aligned with, said support member peripheral edge, said bottom member being fixed to said bottom face of said support member in an area spaced inwardly from said peripheral edges, such that said peripheral edges re unconnected and are capable of becoming separated into a spaced relationship within the container, said peripheral edges adapted to separately engage the at least one interior wall of the container.

2. A partition as in claim 1, wherein said support member further includes a cut extending therethrough to define a manually graspable pull tab for facilitating manual removal of said partition from the container.

3. A partition as in claim 1, wherein said support member peripheral edge configuration is substantially circular.

4. In combination, a downward tapered container having at least one interior wall; and a friction fit partition seated against said at least one interior wall of said tapered container, said partition comprising;

a support member having top and bottom faces and a peripheral edge, said peripheral edge having a configuration substantially corresponding to the interior peripheral configuration of said tapered container, and said support member having an area less than the largest interior cross sectional area of said tapered container; and a bottom member having a peripheral edge substantially identical to, and aligned with, said support member peripheral edge, said bottom member being fixed to said bottom face of said support member in an area spaced inwardly from said peripheral edges, such that said peripheral edges are unconnected and are capable of becoming separated into a spaced relationship within the container, said peripheral edges adapted to separately engage said interior wall of said tapered container.

5. The combination of claim 4, wherein said support member peripheral edge configuration is substantially circular.

6. A plurality of combination, each combination comprising:

a downward tapered container having at least one interior wall; and a friction fit partition seated against said at least one interior wall of said tapered container, said partition comprising;

a support member having top and bottom faces and a peripheral edge, said peripheral edge having a configuration substantially corresponding to the interior peripheral configuration of said tapered container, and said support member having an area less than the largest interior cross sectional area of said tapered container; and a bottom member having a peripheral edge substantially identical to, and aligned with, said support member peripheral edge, said bottom member being fixed to said bottom face of said support member in an area spaced inwardly from said peripheral edges, such that said peripheral edges are unconnected and are capable of becoming separated into a spaced relationship within the container, said peripheral edges adapted to separately engage said interior walls of said tapered container, wherein said tapered containers are arranged in a stacked nested arrangement with a bottom of each of said tapered container, with the exception of a lowermost one of said tapered containers, resting upon and supported by said partition of the combination immediately below.

* * * * *